US007708956B2

(12) United States Patent
Hoehn et al.

(10) Patent No.: US 7,708,956 B2
(45) Date of Patent: May 4, 2010

(54) COMBINATION HOT SEPARATOR AND REACTOR VESSEL FOR SIMULTANEOUSLY DESULFURIZING TWO VAPOR STREAMS

(75) Inventors: Richard K. Hoehn, Mount Prospect, IL (US); Giles R. Maddox, Putney (GB); David A. Lindsay, Benicia, CA (US)

(73) Assignee: UOP LLC, Des Plaines, IL (US)

( * ) Notice: Subject to any disclaimer, the term of this patent is extended or adjusted under 35 U.S.C. 154(b) by 262 days.

(21) Appl. No.: 11/851,763

(22) Filed: Sep. 7, 2007

(65) Prior Publication Data

US 2009/0065397 A1 Mar. 12, 2009

(51) Int. Cl.
*C10G 45/06* (2006.01)

(52) U.S. Cl. ..... 422/211; 203/28; 203/29; 208/208 R; 208/211; 208/213; 208/216 R; 208/217; 208/243; 208/244; 208/354; 208/356

(58) Field of Classification Search ..... 203/28–29, 203/88, 90; 208/211, 213, 352, 361, 208 R, 208/216 R, 217, 243–244, 354, 356; 422/211
See application file for complete search history.

(56) References Cited

U.S. PATENT DOCUMENTS 4,440,626 A 4/1984 Winter et al.
4,701,255 A 10/1987 Baird, Jr.
4,714,539 A 12/1987 Moser et al.
5,643,441 A 7/1997 Timken et al.
5,993,643 A 11/1999 Chang et al.
6,013,173 A 1/2000 Bogdan
6,083,378 A * 7/2000 Gildert et al. ..... 208/209
6,281,398 B1 8/2001 Belloir et al.
6,927,314 B1 8/2005 Schultz et al.
6,946,068 B2 * 9/2005 Groten ..... 208/213
2006/0260927 A1 * 11/2006 Abazajian ..... 203/29

* cited by examiner

*Primary Examiner*—Robert J Hill, Jr.
*Assistant Examiner*—Brian McCaig
(74) *Attorney, Agent, or Firm*—James C. Paschall

(57) ABSTRACT

A method and an apparatus for removing sulfur hydrocarbon compounds from a naphtha stream and for simultaneously removing sulfur hydrocarbon compounds from two streams is described. A separator vessel having a top, a bottom, a primary feed inlet and a co-feed inlet is disposed vertically above the primary feed inlet. The separator vessel further includes a catalyst bed disposed between the co-feed inlet and the top. A primary feed stream comprising sulfur hydrocarbon compounds is delivered through the effluent inlet and a vaporized co-feed stream that also comprises sulfur hydrocarbon compounds is delivered through the co-feed inlet. Vaporized sulfur hydrocarbon compounds from the primary feed stream with the vaporized co-feed stream pass upwardly through the desulfurization catalyst bed. Sulfur hydrocarbon compounds from both primary feed and co-feed stream are at least partially converted to hydrogen sulfide and non-sulfur containing hydrocarbons in the catalyst bed.

19 Claims, 1 Drawing Sheet

COMBINATION HOT SEPARATOR AND REACTOR VESSEL FOR SIMULTANEOUSLY DESULFURIZING TWO VAPOR STREAMS

BACKGROUND

1. Technical Field

This disclosure is directed toward petroleum refining. More specifically, this disclosure is directed toward an improved process and apparatus for reducing sulfur concentrations in both effluent and vapor streams. The disclosed apparatus and method is capable of simultaneously reducing sulfur concentrations in at least one effluent stream and at least one vapor stream to levels of about 0.5 wt ppm or less, as required by modern catalytic reforming equipment.

2. Description of the Related Art

Hydrocracking is the petroleum refining process where complex organic molecules such as kerogens or heavy hydrocarbons are broken down into smaller, simpler molecules such as light hydrocarbons in a catalytic process. Hydrocracking yields middle distillates such as diesel and kerosene, gasoline components such as naphtha, and liquefied petroleum gas (LPG).

Hydrodesulfurization (HDS), also known as hydrotreating, is a catalytic chemical process widely used to remove sulfur from various components during the refining process The removal of sulfur compounds, or more specifically sulfur hydrocarbon compounds such as mercaptans, is important to reduce sulfur dioxide emissions as well as to avoid the poisoning of noble metal catalysts (e.g. platinum, rhenium, etc.) used in downstream catalytic reforming units that upgrade the octane rating of naphtha streams. For example, heavy naphtha product resulting from hydrocracking and/or hydrotreating process is low in octane must be catalytically "reformed" to improve the octane. Further, the presence of sulfur compounds will poison the catalysts used in a reforming unit.

However, in both hydrocracking and hydrotreating units, recombinant sulfur compounds can be formed when the reactor effluent material contains hydrogen sulfide above a certain temperature. The result is the formation of mercaptans that affect the quality of certain products and which boil in the naphtha range.

A catalytic reforming process rearranges or restructures hydrocarbon molecules in the heavy naphtha feed stock as well as breaking some of the compounds into smaller compounds. The overall effect is that the product reformate gains hydrocarbons with more complex molecular shapes having higher octane values than hydrocarbons that comprise the heavy naphtha feed stock. The naphtha feed stock is considered to be "heavy" when it has hydrocarbons with more than six carbon atoms and a naphtha feed stock is considered to be "light" when it includes hydrocarbons of six or less carbon atoms.

Modern reformer technology is typically limited to sulfur concentrations of about 0.5 wt ppm or less because of its reliance upon noble metal catalyst such as platinum or rhenium on a silica-alumina support. The activity of the catalysts is reduced over time by the presence of sulfur compounds. Therefore, the sulfur content of naphtha streams must be reduced prior to entering a reforming unit.

One prior art solution involves the use of a hydrotreating catalyst operating at reduced temperature that can selectively convert mercaptans to hydrogen sulfide and sulfur-free hydrocarbons. The hydrotreating bed must be operated at temperatures high enough for the reactions to take place but low enough to prevent subsequent formation of recombinant sulfur compounds due to the presence of the generated hydrogen sulfide. As a result, the location of the hydrotreating bed in a hot separator has been developed. The reactor effluent material enters a hot separator and the liquid falls and leaves the bottom of the separator vessel. The vapor travels upwardly through the hydrotreating or "post treat" bed and the mercaptan compounds are converted.

Another development is the concept of co-processing. Co-processing involves introducing a feed stream different than the primary feed which is passed through the separator with the sole objective of removing sulfur compounds. Co-processing is typically used downstream of hydrocracking units where there is a need to treat reactor effluent products to remove recombinant sulfur. The co-feed combines with the hydrocracking reactor effluent material and passes through the post treat bed. This concept is appropriate for distillate material which remains in the liquid phase at the conditions of the post treat bed.

Therefore, there is a need for an improved method and apparatus for removing sulfur compounds from naphtha streams including heavy naphtha streams, light naphtha streams and effluent containing naphtha.

SUMMARY OF THE DISCLOSURE

In satisfaction of the aforenoted need, a method for the co-processing and treating of a heavy naphtha stream in a vapor phase upflow of a post treat bed is provided wherein the naphtha co-feed passes through the post treat bed and is not absorbed by the hot separator bottoms liquid. The naphtha co-feed is combined with a hydrogen-rich recycle gas stream and heated to a temperature such that co-feed stream is completely vaporized at the operating conditions of the hot separator vessel. The naphtha co-feed stream is mixed with the hydrogen-rich recycle gas in order to achieve complete vaporization at a temperature lower than that which would be required for naphtha co-feed stream alone.

In an embodiment, the combined stream of naphtha and hydrogen-rich gas is superheated to prevent any condensation prior to entry into the hot separator.

The vaporized naphtha co-feed stream, which includes sulfur hydrocarbon compounds such a mercaptans and others, is then introduced at a point below post treat bed disposed within the hot separator, but above the effluent inlet. The co-feed vapor combines with the vapor from the effluent stream and passes in an upflow fashion through the post treat bed. By insuring that the co-feed is completely vaporized, the problems associated with by-passing of the co-feed below the post treat bed due to solubility of the co-feed material in the hot separator liquid is avoided and therefore the result is a heavy-naphtha co-feed product that meets the sulfur requirements of modern catalytic reformer units.

In an embodiment, a method of continuously removing sulfur hydrocarbon compounds from two streams is provided. The method comprises providing a separator vessel with a top, a bottom, a primary feed inlet and a co-feed inlet. The separator vessel further comprises a catalyst bed disposed between the co-feed inlet and the top. The top includes a vapor outlet and the bottom includes a bottoms outlet.

The method includes delivering a primary feed stream comprising sulfur hydrocarbon compounds through the effluent inlet and delivering vaporized co-feed stream that also comprises sulfur hydrocarbon compounds through the co-feed inlet. The method further includes vaporizing at least a portion of the sulfur hydrocarbon compounds in the primary feed stream and passing the vaporized sulfur hydrocarbon compounds from the primary feed stream and the vaporized co-feed stream, that also comprises sulfur hydrocarbon compounds, upwardly through the catalyst bed where the sulfur hydrocarbon compounds of both the primary feed and co-feed stream are at least partially converted to hydrogen sulfide and hydrocarbons in the catalyst. Finally, the process includes removing the co-feed stream and the vaporized portions of the primary-feed, less at least some sulfur hydrocarbon compounds, through the vapor outlet while removing the primary feed stream through the bottoms outlet.

In a refinement, the primary feed stream is a catalytic cracking reactor effluent stream.

In another refinement, the primary feed stream comprises at least some naphtha.

In another refinement, the co-feed stream comprises naphtha.

In another refinement, the co-feed inlet is disposed above the primary feed inlet.

In yet another refinement, the method further comprises vaporizing the co-feed stream prior to delivering the co-feed stream to the separator vessel by combining a naphtha stream comprising sulfur hydrocarbon compounds and a hydrogen rich stream and heating the combined stream to provide a vaporized co-feed stream.

In another refinement, the separator vessel comprises at least one distributor device connected to the co-feed inlet and at least one distributor device connected to the primary feed inlet.

In another refinement, the catalyst bed comprises a hydrodesulfurization catalyst.

In another refinement the catalyst is a metal sulfide wherein the metal is selected from the group consisting of molybdenum, nickel, tungsten and combinations thereof.

A combination hot separator and desulfurization reactor for removing sulfur hydrocarbon compounds from two feed streams is disclosed. The combination separator and reactor comprises a vessel comprising a top, a bottom, an effluent inlet in communication with a catalytic cracking unit, co-feed inlet in communication with a naphtha source and a hydrocracking bed deposed between the top and the co-feed inlet. The co-feed inlet is disposed above the effluent inlet. The top of the vessel comprises a vapor outlet and the bottom of the vessel comprises a bottoms outlet. The vessel further comprises a Hydrodesulfurization catalyst bed disposed between the co-feed inlet and the top of the vessel.

In an embodiment, the vapor outlet and the bottoms outlet are passed through a fractionation column before the naphtha range components are passed through a catalytic reforming unit.

Other advantages and features will be apparent from the following detailed description in conjunction with the attached drawing.

BRIEF DESCRIPTION OF THE DRAWING

For a more complete understanding of the disclosed methods and apparatuses, reference should be made to the embodiment illustrated in greater detail in FIG. 1 which is a schematic illustration of a combination hot separator/reactor designed in accordance with this disclosure.

DETAILED DESCRIPTION OF THE PRESENTLY PREFERRED EMBODIMENTS

Figure 1:
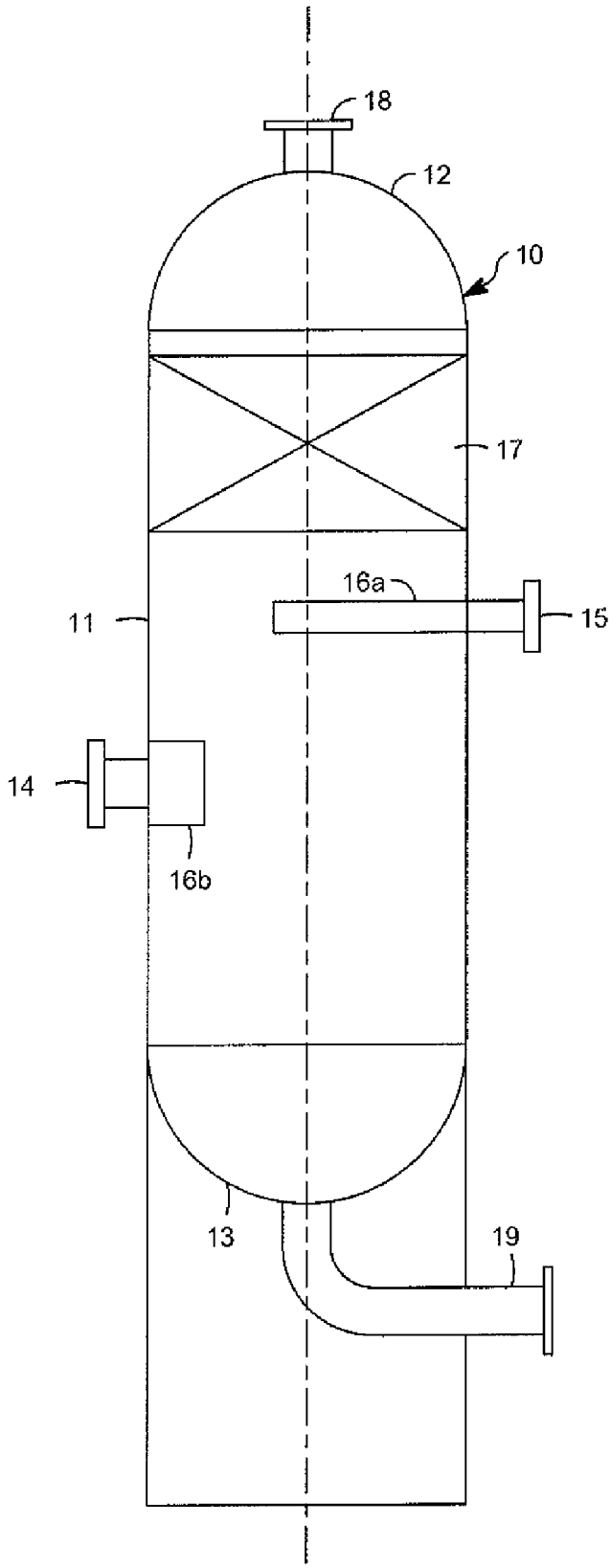

A combination hot separator/reactor vessel 10 is illustrated in FIG. 1. The vessel 10 includes a cylindrical side wall 11 with a rounded top 12 and a rounded bottom 13. The side wall 11 is connected to an effluent inlet 14 and a co-feed inlet 15. It will be noted that the co-feed inlet 15 is preferably disposed above the effluent feed inlet 14 as the co-feed inlet 15 is connected to a naphtha source and the naphtha has been vaporized by mixing naphtha with a hydrogen-rich gas and the combination has been heated so that the co-feed stream passing through the co-feed inlet 15 is completely vaporized. In contrast, the effluent passing through the effluent inlet 14 is predominately liquid. In a refinement, the effluent inlet 14 delivers naphtha and heavier hydrocarbons to the vessel 10 allowing the naphtha to flash from the heavier hydrocarbons. By placing the co-feed inlet 15 above the effluent or primary feed inlet 14, the problems associated with heavy naphtha combining with the effluent and passing downward with the bottoms liquid is avoided.

The primary feed is delivered through the effluent inlet 14 at temperatures that can range from about 232 to about 343° C. (~450-~650° F.). The vessel pressure can vary widely from about $5.5\times10^5$ to about $2.1\times10^6$ Pa (~800-~3000 psi). The vaporized co-feed can be delivered at temperatures ranging from about 150 to about 315° C. (~300-~600° F.).

Distributors are indicated schematically at 16*a*, 16*b*. The distributor 16*a* for the co-feed inlet 15 may be in the form of an elongated pipe with a plurality of spaced-apart nozzles or openings. The distributor 16*b* for the primary or effluent feed inlet 14 may be a conventional feed distributor. Preferably, all or close to all of the naphtha passes upwardly in the vapor phase.

A catalyst bed is indicated at 17. The catalyst is preferably a hydrodesulferization catalyst or hydrotreating catalyst. Preferably, the catalyst is a metal sulfide wherein the metal is selected from the group consisting molybdenum, nickel, tungsten and combinations thereof disposed on an alumina or a γ-alumina support.

As noted above, the co-feed preferably comprises a naphtha stream containing sulfur hydrocarbon compounds that need to be removed prior to treating the naphtha stream in a reforming unit. The naphtha is preferably vaporized by combining the naphtha stream with hydrogen stream or a hydrogen-rich stream and then heating the combined stream until the stream is vaporized before it enters the vessel 10 through the co-feed inlet 15. The vaporized naphtha then proceeds upward through the catalyst bed 17 and out the vapor outlet 18 which is preferably in communication with a reforming unit. Further, the effluent stream passing through the inlet 14 enters the separator vessel 10 and vapor from the reactor effluent stream passes upward through catalyst bed 17 with the vaporized co-feed. Liquid in the effluent stream passes down through the bottom outlet 19, which may also be sent to the reforming unit.

One advantage of the apparatus and method described herein is improved naphtha product quality passing through the vapor outlet 18 and a more effective use of the post treat catalyst 17 In contrast to the disclosed method, routing naphtha product to a post treat bed for further treatment using an expensive material, such as zinc oxide, to remove the remaining sulfur prior to routing the naphtha product to a catalytic reformer is unnecessary.

While only certain embodiments have been set forth, alternatives and modifications will be apparent from the above description to those skilled in the art. These and other alternatives are considered equivalents and within the spirit and scope of this disclosure and the appended claims.

The invention claimed is:

1. A method of contemporaneously removing sulfur hydrocarbon compounds from two streams, the method comprising:

providing a separator vessel comprising a top, a bottom, a primary feed inlet and a co-feed inlet, the separator vessel further comprising a catalyst bed disposed between the co-feed inlet and the top, the top comprising a vapor outlet, the bottom comprising a bottoms outlet;

delivering a primary feed stream comprising sulfur hydrocarbon compounds through the primary feed inlet;

delivering a vaporized co-feed stream also comprising sulfur hydrocarbon compounds through the co-feed inlet;

vaporizing the co-feed stream prior to delivering the co-feed stream to the separator vessel;

vaporizing at least a portion of the sulfur hydrocarbon compounds in the primary feed stream and passing the vaporized sulfur hydrocarbon compounds from the primary feed steam with the vaporized co-feed steam upward through the catalyst bed wherein sulfur hydrocarbon compounds of both the primary feed steam and co-feed stream are at least partially converted to hydrogen sulfide and hydrocarbons in the catalyst bed;

removing the co-feed stream and vaporized portion of the primary feed stream, less at least some sulfur hydrocarbon compounds, through the vapor outlet; and removing the primary feed stream through the bottoms outlet.

2. The method of claim 1 wherein the primary feed stream is a hydrocatalytic cracking reactor effluent stream.

3. The method of claim 1 wherein the primary feed stream comprises at least some naphtha.

4. The method of claim 1 wherein the co-feed stream comprises naphtha.

5. The method of claim 1 wherein the co-feed inlet is disposed above the primary feed inlet.

6. The method of claim 1 wherein vaporizing the co-feed stream prior to delivering the co-feed stream to the separator vessel comprises combining a naphtha stream comprising sulfur hydrocarbon compounds and a hydrogen-rich stream and heating the combined stream to provide the vaporized co-feed stream.

7. The method of claim 6 wherein the combined stream is superheated.

8. The method of claim 1 wherein the co-feed inlet is connected to a first distributor device and the primary feed inlet is connected to a second distributor device.

9. The method of claim 1 wherein the catalyst bed comprises a hydrodesulfurization catalyst.

10. A method of contemporaneously removing sulfur hydrocarbon compounds from two streams, the method comprising:

providing a separator vessel comprising a top, a bottom, an effluent inlet and a co-feed inlet disposed above the effluent inlet, the separator vessel further comprising a catalyst bed disposed between the co-feed inlet and the top, the top comprising a vapor outlet, the bottom comprising a bottoms outlet;

delivering a catalytic cracking reactor effluent stream comprising sulfur hydrocarbon compounds through the effluent inlet;

delivering a vaporized co-feed stream comprising sulfur hydrocarbon compounds and hydrogen-rich gas through the co-feed inlet;

vaporizing at least a portion of the sulfur hydrocarbon compounds in the effluent stream and passing the vaporized sulfur hydrocarbon compounds from the effluent steam with the vaporized co-feed steam upward through the catalyst bed wherein sulfur hydrocarbon compounds of both the effluent steam and co-feed stream are converted to hydrogen sulfide and hydrocarbons in the catalyst bed;

removing the co-feed stream and vaporized portion of the effluent stream, less at least some sulfur hydrocarbon compounds, through the vapor outlet; and removing the effluent stream through the bottoms outlet.

11. The method of claim 10 further comprising vaporizing the co-feed stream prior to delivering the co-feed stream by combining a naphtha stream comprising sulfur hydrocarbon compounds and a hydrogen-rich gas stream and heating the combined stream to provide the vaporized co-feed stream.

12. The method of claim 11 wherein the combined stream is superheated.

13. The method of claim 10 further comprising a first distributor device connected to the co-feed inlet and a second distributor device connected to the effluent feed inlet.

14. The method of claim 10 wherein the catalyst bed comprises a hydrodesulfurization catalyst.

15. The method of claim 10 wherein the primary feed stream comprises at least some naphtha.

16. The method of claim 15 wherein the co-feed comprises naphtha.

17. A combination hot separator and desulfurization reactor system for removing sulfur hydrocarbon compounds from two feed streams, the combination separator and reactor system comprising:

a catalytic cracking unit;

a reforming unit;

a vessel comprising a top, a bottom, an effluent inlet in communication with said catalytic cracking unit, a co-feed inlet in communication with a naphtha source and a catalyst bed disposed between the top and the co-feed inlet, the co-feed inlet being disposed above the effluent inlet;

the top of the vessel comprising a vapor outlet in communication with said reforming unit;

the bottom of the vessel comprising a bottoms outlet;

the vessel further comprising a hydrodesulfurization catalyst bed disposed between the co-feed inlet and the top.

18. The separator and reactor of claim 17 further comprising a first distributor device connected to the effluent inlet and a second distributor device connected to the co-feed inlet.

19. The separator of claim 17 wherein the catalyst is a metal sulfide wherein the metal selected from the group consisting of molybdenum, nickel, tungsten and combinations thereof.

* * * * *